US007102561B2

(12) United States Patent
Tokita

(10) Patent No.: US 7,102,561 B2
(45) Date of Patent: Sep. 5, 2006

(54) RADIO CONTROL TRANSMITTER

(75) Inventor: Masashi Tokita, Chiba (JP)

(73) Assignee: Futaba Corporation, (JP)

( * ) Notice: Subject to any disclaimer, the term of this patent is extended or adjusted under 35 U.S.C. 154(b) by 401 days.

(21) Appl. No.: 10/437,028

(22) Filed: May 14, 2003

(65) Prior Publication Data

US 2003/0214428 A1 Nov. 20, 2003

(30) Foreign Application Priority Data

May 15, 2002 (JP) ..... 2002-140831

(51) Int. Cl.
*H04L 17/02* (2006.01)
*G08C 19/12* (2006.01)
*G08C 19/00* (2006.01)

(52) U.S. Cl. ..... 341/176; 340/825.69

(58) Field of Classification Search ..... 341/176, 341/446, 454; 340/825–69; 446/456, 454
See application file for complete search history.

(56) References Cited

U.S. PATENT DOCUMENTS 5,158,495 A * 10/1992 Yonezawa ..... 446/456
2002/0196174 A1* 12/2002 Lai ..... 341/176
2005/0168373 A1* 8/2005 Mukaida ..... 341/176

FOREIGN PATENT DOCUMENTS

JP 10314463 * 2/1998

* cited by examiner

*Primary Examiner*—Jeffery Hofsass
*Assistant Examiner*—Sisay Yacob
(74) *Attorney, Agent, or Firm*—Bacon & Thomas PLLC

(57) ABSTRACT

A radio control transmitter capable of enhancing controllability of a remotely controlled unit, for example a model car includes a control unit having switches 8 for controlling the neutral positions of servos that operate based on control inputs of a throttle trigger 3 and a steering wheel 4, wherein the switches 8 are provided on a control unit 10 that rotatably supports the steering wheel 4, corresponding to a mount 2*a* of a main body. The control unit 10 is detachably installed corresponding to the mount 2*a* of the main body, while capable of being attached to a discretionary position in the direction of rotation. Accordingly, the position of the switches 8 can be adjusted to meet the needs of a user. Consequently, the user can operate the controlled unit with enhanced controllability.

3 Claims, 8 Drawing Sheets

RADIO CONTROL TRANSMITTER

FIELD OF THE INVENTION

The present invention relates to a radio control device using radio frequency link to remotely control a radio controlled unit; and, more particularly, a radio control transmitter using radio frequency link to transmit commands executed by a user to the radio controlled unit.

BACKGROUND OF THE INVENTION

For a radio control device that uses a radio frequency link to transmit commands to a radio controlled unit such as a model car, a user operates a radio control transmitter in order to remotely control the commands transmitted to the radio controlled unit. The transmitted commands control the operating range of a speed control servo and a direction control servo placed in the radio controlled unit, thereby enabling remote control thereof. One of such conventional radio control transmitters is illustrated in FIG. 8. (The transmitter shown in FIG. 8 is intended for a right-handed user) Such conventional radio control transmitter is of a wheel type including a grip handle 1, a main body 2, a throttle trigger 3, a steering wheel 4, an antenna 5, a battery case 6, and a display 7. Ordinarily, the user grips the handle 1 with the left hand in a manner similar to gripping a pistol and places the index finger on the throttle trigger 3, whereas the right hand is placed on the wheel 4 disposed in the center of a front face the main body 2. In case of operating a radio controlled unit, e.g., a model car, by employing such radio control transmitter, the throttle trigger 3 can be squeezed with varying degree in the direction of arrow A to move the radio controlled unit forward at a speed corresponding to the squeezed degree. And when the throttle trigger 3 is pushed forward in the direction of arrow B, the controlled unit moves backward at a speed corresponding to the amount of push or, in case of the unit incapable of moving backward, the brakes thereof operate for example. Moreover, when the operator turns the wheel 4 in a clockwise direction (in the direction of arrow C), the radio controlled unit turns to the right in conformity with the degree of the turn. Likewise, when the operator turns the steering wheels 4 in a counterclockwise direction (in the direction of arrow D), the radio controlled unit turns to the left in response to the degree of the turn. Accordingly, by manipulating in combination the throttle trigger 3 and the steering wheel 4, the user can remotely control the radio controlled unit.

Furthermore, the radio control transmitter of this sort is further provided with a mechanism to regulate controlled variables in controlling the radio controlled unit based on the control inputs of the throttle trigger 3 and the steering wheel 4. More specifically, the controlled variables can be regulated by controlling the neutral position and the maximum rudder angle (maximum operating range) for each of the speed control servo and the direction control servo that operate in response to the amount of inputs of the throttle trigger 3 and the steering wheel 4. Such task of controlling the neutral position and the maximum rudder angles of the servos are carried out by switches that are conventionally located near the throttle trigger 3 and the steering wheel 4, so that such control can be carried out while remotely controlling the radio controlled unit. Referring to the radio control transmitter illustrated in FIG. 8, the adjustment of the neutral positions of the servos for controlling the speed and the direction is performed by utilizing switches 8 provided near the steering wheel 4, wherein there are three switches 8 provided in a top vertical portion and left and right horizontal portions with respect to the axial line of steering wheel 4. One of the switches 8 is installed for adjusting the neutral position of the speed control servo and another for adjusting the direction control servo. The adjustment of the rudder angles (maximum operating range) of the speed control servo and the direction control servo is performed by utilizing a dial 9 placed near the throttle trigger 3, enabling the user to remotely control the radio controlled unit while observing its motion.

Although the switches 8 described above are disposed near the steering wheel 4 to be operable while remotely controlling the radio controlled unit, they are rigidly fixed to pre-specified locations. Despite such configuration, users come from various age groups ranging from a child to an adult, each having different hand holding postures and grips. In particular, with users having various grips, certain users may encounter a great difficulty especially in operating rigidly fixed switches while holding the steering wheel. Accordingly, such configuration may pose great difficulties in controlling the neutral position or the maximum rudder angle while manipulating the steering wheel. Consequently, operating the radio controlled unit under such configuration may force the user to lose control thereof. In case of a model car being controlled by the radio control transmitter under such configuration, the model car may incur collisions with walls or other obstacles for lack of control the user has thereon with such radio control transmitter.

Recent trends show operability of such radio control transmitter has been improving. By interposing an adapter between the main body and the steering wheel, the steering wheel can be placed at positions other than the conventionally pre-determined position (at the center of the front face). In general, the position of the steering wheel is adjusted with the adapter to about the height of the throttle trigger. However, even with such adapters allowing for an adjustment of the location of the steering wheel, there is a need for an easily accessible and operable switches.

SUMMARY OF THE INVENTION

It is, therefore, an object of the present invention to provide a radio control transmitter capable of enhancing controllability of a radio controlled unit by enabling switches to be adjustable to a user preferred position.

In accordance with the present invention, there is provided a radio control transmitter, including: a main body having a control, for transmitting command signals to a controlled unit based on a control input of the control, the control containing a steering wheel for governing the rudder angle of the steering of the controlled unit and a throttle trigger providing at least one of speed governing mechanism and drive control in forward and backward motion of the controlled unit; a switch for adjusting controlled variable of the control input of the throttle trigger and steering wheel; and a control unit incorporating the switch and the steering wheel rotatably installed thereon, wherein the control unit is adjustably placed at any one of a plurality of positions in the direction of rotation about an axis of the steering wheel, with respect to the main body.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENT

Figure 1:
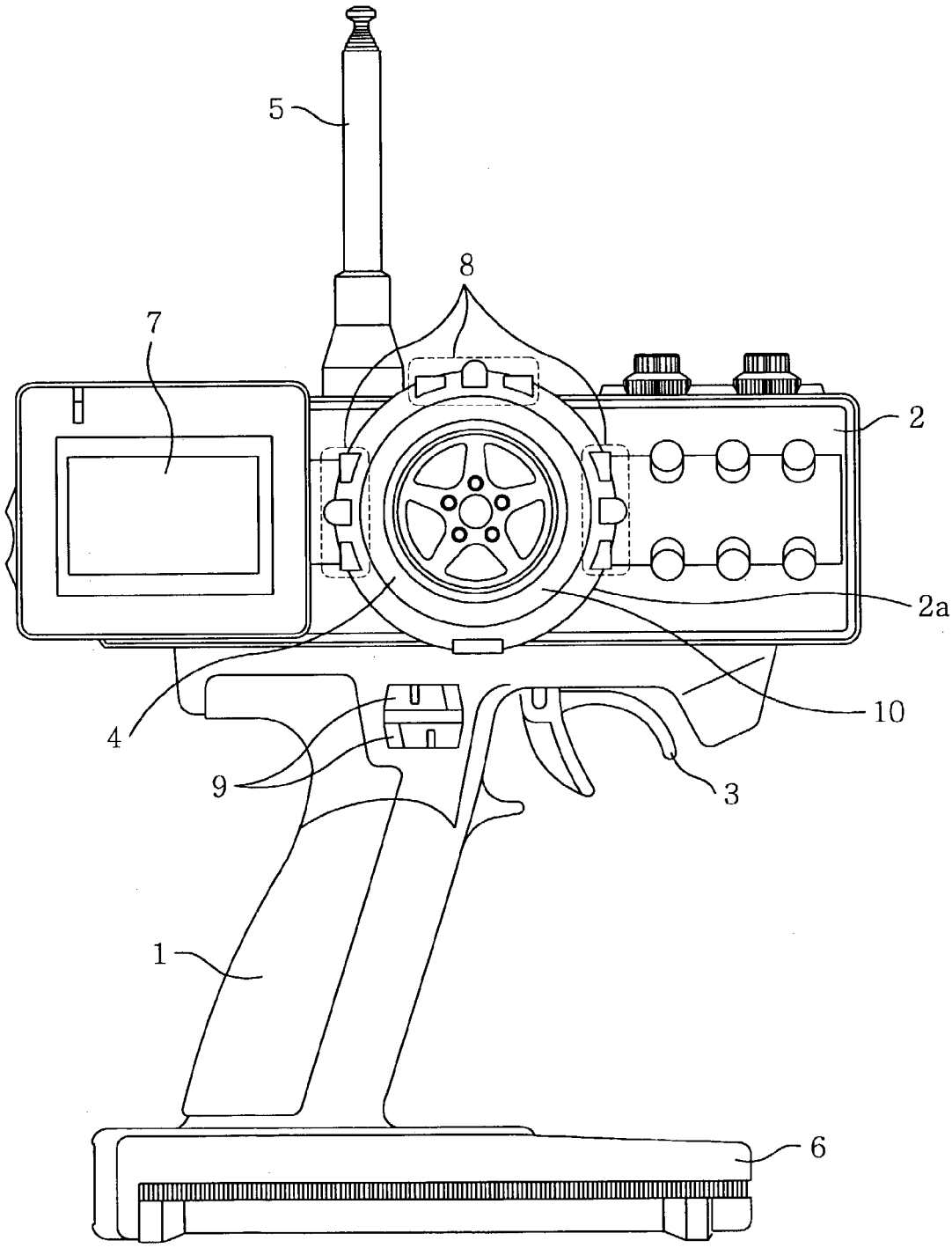
FIG. 1 is a front view of a radio control transmitter in accordance with a first preferred embodiment of the present invention.
Figure 2:
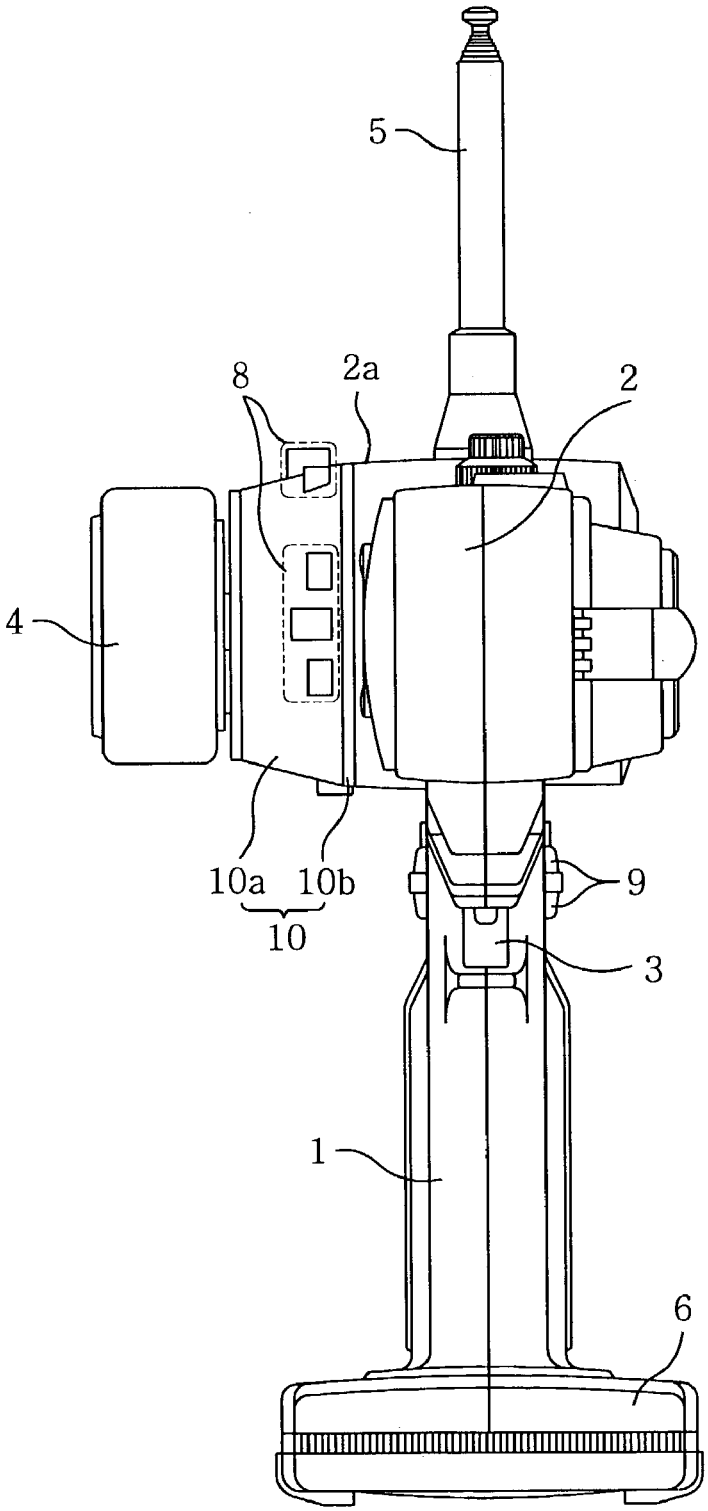
FIG. 2 describes a right side elevational view of the radio control transmitter in accordance with the first preferred embodiment of the present invention.
Figure 8:
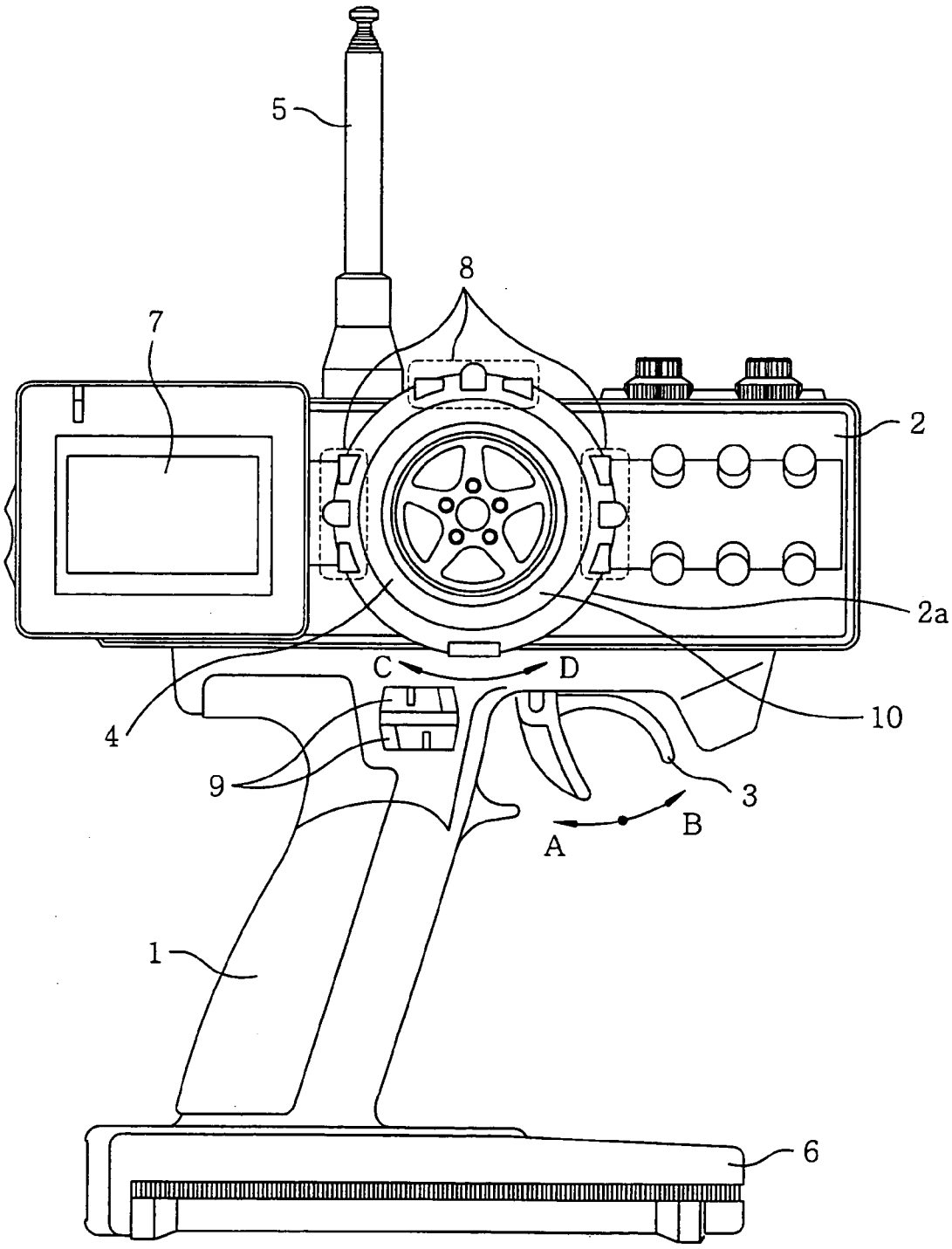
FIG. 8 (PRIOR ART)
FIG. 8 depicts a schematic view of a prior art radio control transmitter illustrating configuration thereof.

The preferred embodiments of the present invention will now be described with reference to the accompanying drawings. FIGS. 1 and 2 are respectively a front view and a right side elevational view of a radio control transmitter in accordance with a first preferred embodiment of the present invention. The radio control transmitter shown is intended for a right-handed user. The basic layout of the radio control transmitter of the present invention closely resembles that of the conventional art as described with reference to FIG. 8. Like parts will be designated with like reference numerals and an elaboration of substantially identical parts and directions for use thereof will be omitted.

As illustrated in FIGS. 1 and 2, switches 8 are provided on a control unit 10 interposed between a steering wheel 4 (hereinafter referred to as the wheel) and a mount 2*a*, which is disposed in the center of the front face of the main body 2, the control unit 10 rotatably supporting the wheel 4 with respect to the mount 2*a* of the main body 2. Moreover, the control unit 10 is detachably installed on the mount 2*a* of the main body 2 through a configuration and mechanism thereof, as will be described in detail below. Furthermore, the control unit 10 can be installed in a discretionary position in the direction of rotation. Accordingly, if the switch 8 is placed in an undesirable position in controlling the controlled unit, the user can place the switch 8 in a more preferred position by adjusting the position of the control unit 10.

Figure 3:
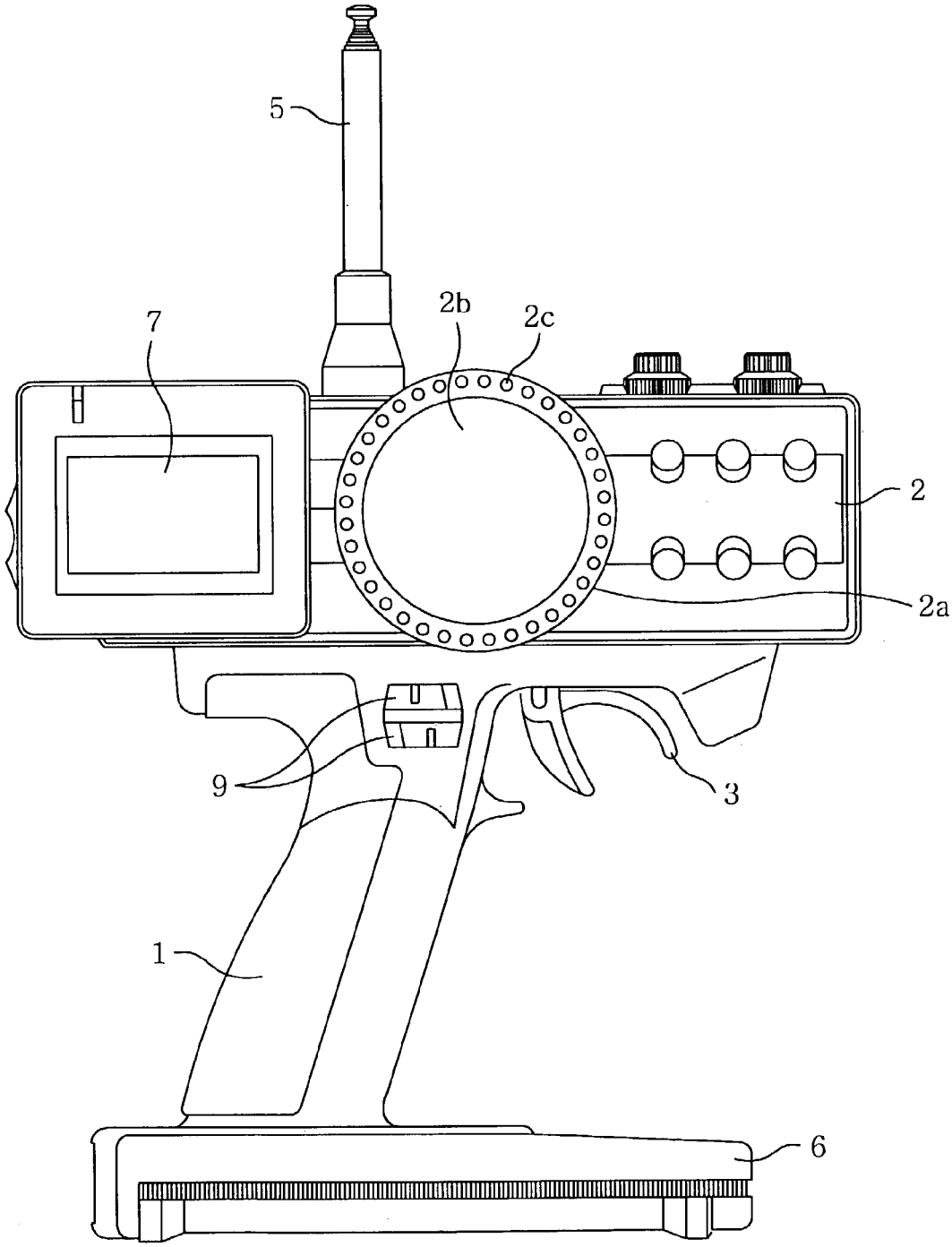
FIG. 3 shows a front view of the radio control transmitter with a control unit removed.

Hereinafter, the configuration and the mechanism, which allows for the adjustment of the position of the switch 8 on the mount 2*a* of the main body 2, will now be described. FIG. 3 illustrates the main body 2 shown in FIG. 1 having removed the control unit 10 from the mount 2*a* of the main body. As illustrated in FIG. 3, the mount 2*a* of the main body 2 is provided with a circular recess 2*b*, into which the control unit 10 is fitted. A plurality of threaded holes 2*c* having pre-determined spacing therebetween are circumferentially provided on the outer periphery of the recess 2*b* for securing the control unit 10. Furthermore, there is provided at a portion of the recess an aperture (not illustrated) for passing therethrough wires for connecting a circuitry in the main body 2 with printed circuit boards of the control unit 10.

Figure 4A:
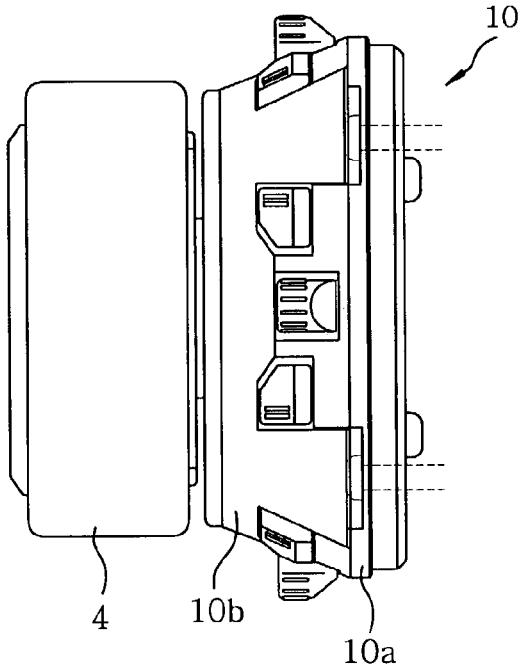
FIGS. 4A and 4B offer a side elevational view and a front view of the control unit, respectively.
Figure 4B:
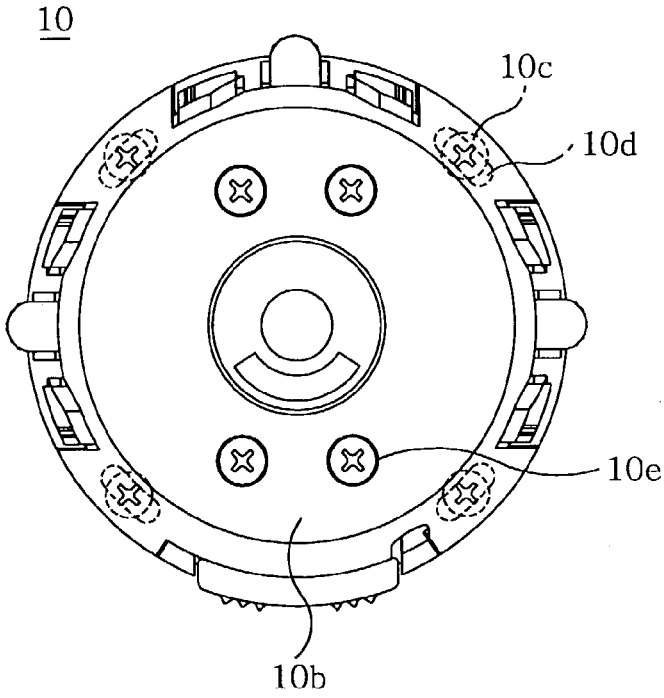

FIGS. 4A and 4B are a side view and a front view of the control unit 10, respectively. FIG. 4A shows the wheel 4 and FIG. 4B shows holes 10*d* and screws 10*c* for securing the control unit 10. In addition to the switch 8, the control unit 10 further includes, for example a printed circuit board for wiring purposes, a support for supporting the printed circuit board, and a potentiometer (variable resistor) for determining the amount of rotation of the wheel 4. Such components are assembled as units to form a base member 10*a*, and are covered by a cover 10*b*. As shown in FIG. 4A, a protrusion of circular shape to be mated with the recess 2*b* provided on the mount 2*a* of the main body 2 is formed on a surface (opposite to a surface which hosts the wheel 4) of the base member 10*a* in contact with the mount 2*a* of the main body 2. The control unit 10 is rotatably installed while mating the protrusion with the recess 2*b*. Moreover, there is provided in a portion of the contact surface an aperture for allowing the connection of a wire drawn from the circuitry of the main body 2 with printed circuit board of the control unit 10. Furthermore, as illustrated in FIG. 4B there are provided four substantially oval shaped holes 10*d* on the circumference of the base member 10*a* in order to secure the control unit 10 on the mount 2*a* of the main body 2 with control unit securing screws 10*c*. When the control unit 10 is rotated while having the protrusion in the base member 10*a* mated with the recess 2*b* provided in the mount 2*a* of the main body 2, regardless of the position in the direction of rotation of the control unit 10, all the substantially oval shaped holes 10*d* are positioned so as to coincide with the threaded screw holes 2*c*. Accordingly, the control unit 10 can be secured onto the mount 2*a* of the main body 2, regardless of the position in the direction of rotation thereof. Moreover, the cover 10*b* is securely screwed onto the base member 10*a* from the side of the wheel 4 by cover screws 10*e*. According to thus described configuration and components of the main body 2 and the control unit 10, the control unit 10 can be secured in any discretionary position in the direction of the rotation thereof and further the switch 8 can be installed in a user-preferred position; and therefore, the user can easily manipulate the control of the controlled unit.

Hereinafter, the steps for adjusting the position of the switch 8 will be explained. First, the wheel securing screws are unscrewed to free the wheel 4 from the control unit 10, followed by unscrewing of the cover screws 10*e* to enable removal of the cover 10*b* from the base member 10*a*. After removing the cover 10*b* from the base member 10*a*, control unit screws 10*c*, which secured the control unit 10 onto the main body 2, are unscrewed, thereby making the control unit 10 detachable from the main body 2. At this time, the user can rotate and adjust the control unit 10 to place the switch 8 in a desired position. After determining the desired position of the switch 8, control unit securing screws 10*c* are screwed through the hole 10*d* and into the threaded screw hole 2. Thereafter, the detached cover 10*b* and the wheel 4 are secured. In this way, depending on the positioning of the control unit 10, the position of the switch 8 is correspondingly changed. The above-described steps are taken when a substantial change takes place in the switch 8 position. When only a slight change in the switch 8 position is required, the control unit securing screw 10*c* need not be completely unscrewed, but instead can be loosened just enough for the switch 8 position to be adjusted within the clearance allowed by the substantially oval shaped hole 10*d*. By combining the two methods just described, the user can accurately change the position of the switch 8 to a desired position, thereby facilitating controllability of the switch 8 while simultaneously controlling the wheel 4.

Figure 5:
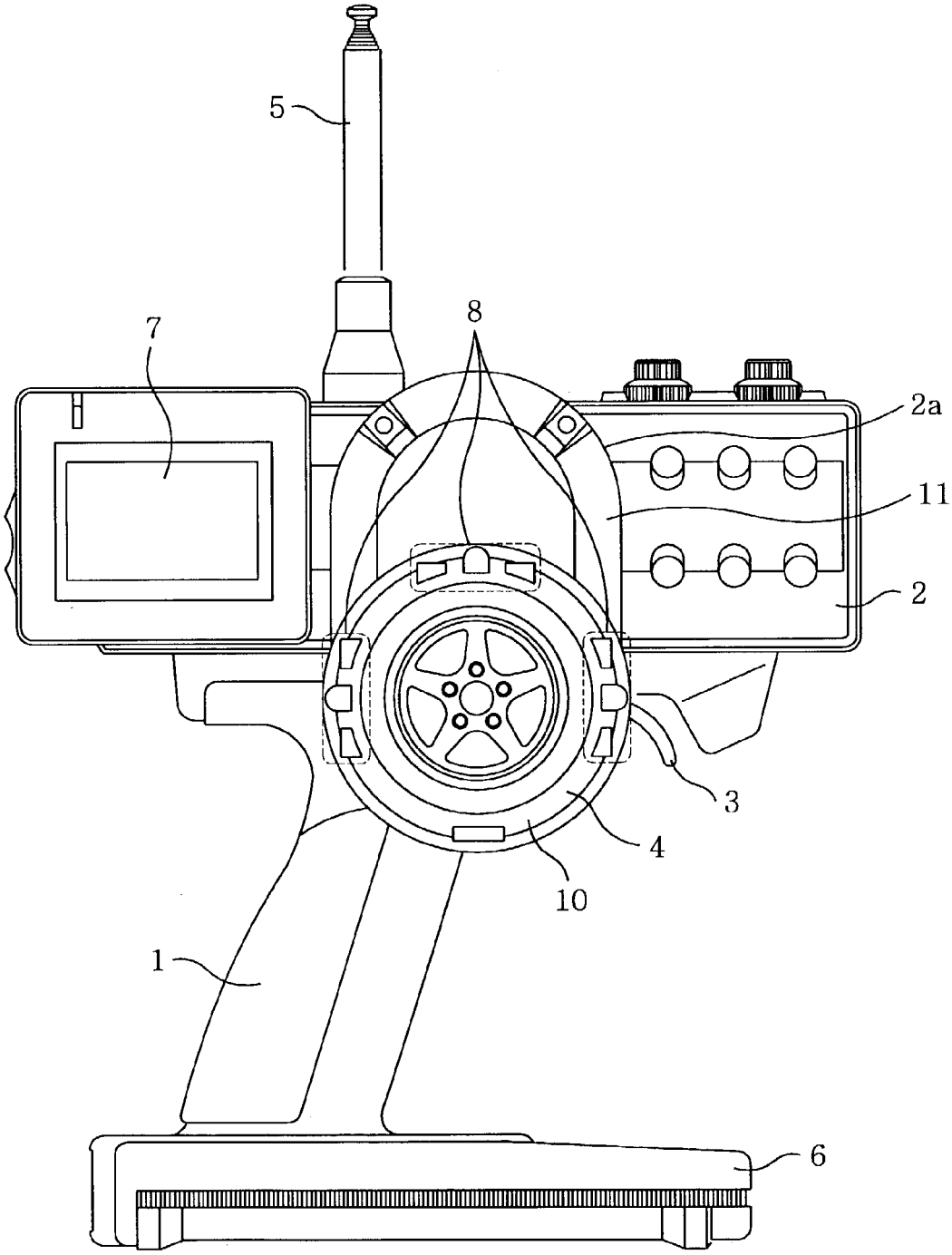
FIG. 5 is a front view of a radio control transmitter in accordance with a second preferred embodiment of the present invention.
Figure 6:
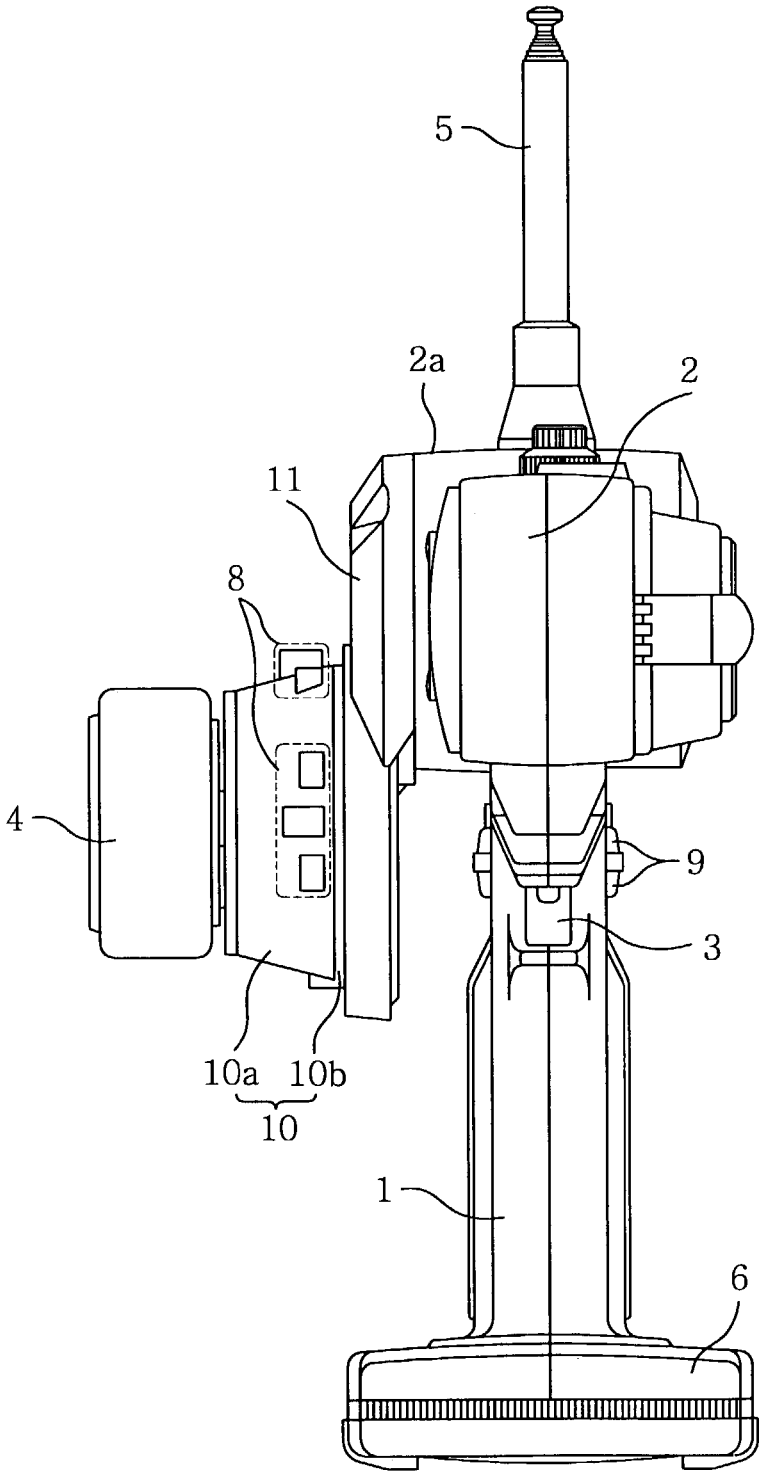
FIG. 6 provides a right side elevational view of the radio control transmitter in accordance with the second preferred embodiment of the present invention.

Hereinafter, a second preferred embodiment of a radio control transmitter in accordance with the present invention will be explained. The radio control transmitter of the second preferred embodiment is similar to that of the first preferred embodiment except for an additionally included adapter. FIGS. 5 and 6 are a front view and a right side elevational view of the radio control transmitter, respectively. The radio control transmitter of the second preferred embodiment, which is substantially identical to that of the first preferred embodiment, e.g., both intended for a right-handed user, has a configuration and the directions for use that are substantially identical to those of the first preferred embodiment. Accordingly, parts that are identical to those in FIGS. 1, 2, and 8 will be assigned identical reference numerals and explanation thereof will be omitted.

By interposing an adapter 11 between a main body 2 and a control unit 10, the wheel 4 and the control unit 10 can be placed in a position other than the center of the front face of the main body 2, where conventionally placed. Although the front view of the radio control transmitter illustrated in FIG. 5 reveals the control unit 10 being disposed nearly flush with the throttle trigger 3, the control unit 10 can be adjusted to other user-preferred positions which is rotated about the center of the mount 2*a* of the main body 2. The switch 8 is provided on the control unit 10 as described in the first preferred embodiment. The position of the switch 8 can be adjusted by rotating the control unit 10 with about the axis of rotation of the wheel 4 on the control unit mount 11*a* of the adapter 11. Accordingly, in the case of securing the wheel 4 and the control unit 10 with the adapter 11, the position of the switch 8 can also be adjusted to meet the desired position for the user.

Figure 7A:
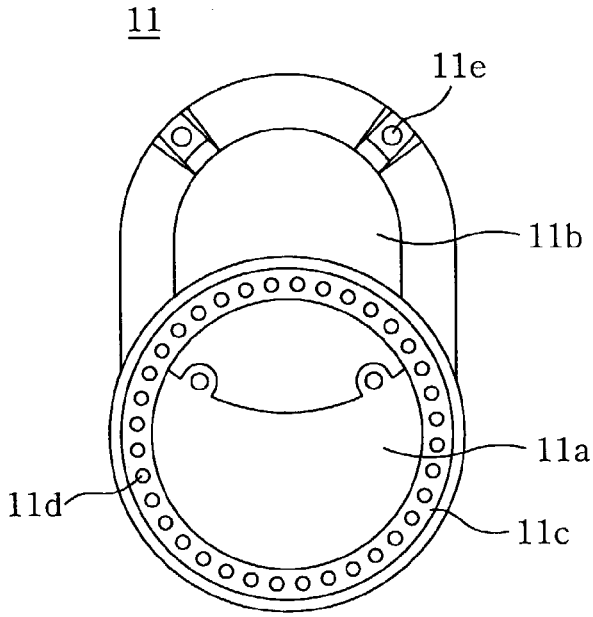
FIGS. 7A and 7B present a front view and a side elevational view of an adapter, respectively.
Figure 7B:
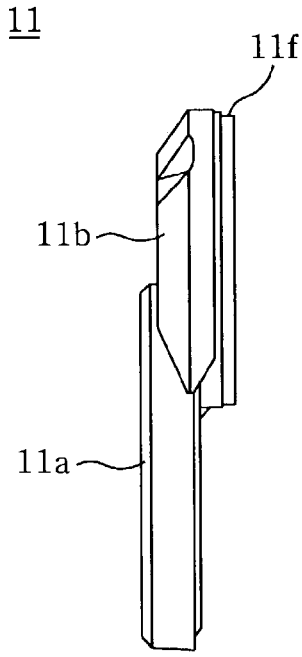

The radio control transmitter of the second preferred embodiment with an exception of the adapter 11, has the same configuration as that of the first preferred embodiment. Accordingly, the configuration of the adapter 11 will be explained hereinafter. FIGS. 7A and 7B illustrate a front view of the adapter 11 and a right side elevational view, respectively. As illustrated in FIGS. 7*a* and 7*b*, the adapter 11 is formed of two partially overlapping circular portions. One of the two partially overlapping circular portions is a control unit mount 11*a* for mounting the control unit 10 thereon, and the other circular portion is an adapter mount 11*b* for securing the adapter 11 onto the corresponding mount 2*a* of the main body 2.

The configuration of the control unit mount 11*a* is substantially identical to the mount 2*a* of the main body 2 in the above-described preferred embodiment of the radio control transmitter, wherein a recess 11*c* is provided for securing the control unit 10 on the adapter 11, and further provided is a plurality of securing holes 11*d* circumferentially arranged at a specified interval in the outer periphery of the recess. Moreover, there is provided in a portion of the recess an aperture through which wires from the circuitry in the main body 2 pass, to be connected with the printed circuit board in the control unit 10.

A circumferential rim 11*f* to be mated with the recess 2*b* provided on the mount 2*a* of the main body is formed on a circumferential portion of the rear surface of the adapter mount 11*b* in contact with the mount 2*a*. Further provided on the circumferential rim 11*f* are four adapter securing holes 11*e* for rigidly securing the adapter 11 onto the mount 2*a* of the main body 2 by using screws.

The adapter 11 is rotatably configured while mating the circumferential rim 11*f* with the recess 2*b*. Accordingly, the control unit 10 can be mounted on the adapter 11, such that the control switch 8 of the radio control transmitter of the preferred embodiment of the present invention is positioned according to user preference. The wheel 4 and the control unit 10 can be installed at any discretionary position in the direction of rotation about the center of the mount 2*a* of the main body 2.

The radio control transmitter of the preferred embodiments described above is intended for a right-handed user. In such case, the control unit 10 and the adapter 11 are placed in the center of the front face of the mount 2*a* of the main body 2. However, the present invention is not limited to such configuration. The control unit 10 and the adapter 11 may be placed in the center of the rear face of the main body 2, in other words, on the face opposite to the front face of the mount 2*a* of the main body 2, thereby accommodating a left handed user. That is, when the mount 2*a* of the main body 2 is formed on both the front and the rear faces of the main body 2, the radio control transmitter can be adapted for a right or left-handed user, to thereby achieve the same benefits as described above.

The radio control transmitters of the preferred embodiments of the present invention are capable of making even a small adjustment to the position of the switch 8 as a result of the substantially oval shaped holes 10*d* provided in the base member 10*a* of the control unit 10. However, the substantially oval shaped holes 10*d* provided in the base member 10*a* of the control unit 10 may be of a circular shape. In this case, the adjustment can only be made steppedly since the control unit 10 is secured to the threaded screw holes provided in the mount 2*a* of the main body 2, however, substantially the same benefits as the above described preferred embodiments of the present invention may be obtained.

The switches 8 of the radio control transmitters of the preferred embodiments of the present invention are employed in a manner similar to a conventional switch, in controlling the neutral position of the speed control servo and direction control servo that operate based on the control input of the throttle trigger 3 and the steering wheel 4. However, according to the setting of the transmitter, the switches can be used to control maximum rudder angle and the maximum operating range of the speed control servo and the direction control servo, and still obtained the same benefits of the present invention.

In accordance with the radio control transmitter of the present invention, a control unit having a switch that controls the controlled variable governing the controlled unit based on the control input of a throttle trigger and a wheel, is rotatably installed on a main body of the transmitter and is capable of adjusting position thereof, thereby enabling the switch to be placed in a user preferred position (orientation). Accordingly, the user can simultaneously operate the wheel and the switch. The rate of occurrences of the control miss is reduced, thereby reducing damages that may take place on the controlled unit.

While the invention has been shown and described with respect to the preferred embodiment, it will be understood to those skilled in the art that various changes and modifications may be made without departing from the spirit and scope of the invention as defined in the following claims.

What is claimed is:

1. A radio control transmitter for transmitting command signals to a controlled unit, comprising:

a main body;

a throttle trigger provided on the main body for providing at least one of speed governing mechanism and drive control in forward and backward motion of the controlled unit; and a control unit provided on the main body, the control unit including a steering wheel rotatably installed thereon and switches, wherein the steering wheel governs a rudder angle of a steering of the controlled unit and the switches adjust controlled variables from the throttle trigger and the steering wheel, wherein the control unit is adjustably placed at any position in a direction of rotation about a rotation axis of the steering wheel with respect to the main body.

2. The radio control transmitter of claim 1, wherein the control unit is secured to the main body via an adapter, and the control unit is slidably mounted to the adapter.

3. The radio control transmitter of claim 2, wherein the adapter is rotatably installed on the main body, and adjustably secured at any position in the a rotational direction thereof.

* * * * *